US012790911B2

(12) United States Patent
Al-Ghamdi et al.

(10) Patent No.: US 12,790,911 B2
(45) Date of Patent: Nov. 10, 2026

(54) MECHANISMS AND SYSTEMS TO RETRIEVE WIRELINE Y-PLUG IN ESP WELLS

(71) Applicant: SAUDI ARABIAN OIL COMPANY, Dhahran (SA)

(72) Inventors: Ahmed Abdullah Al-Ghamdi, Al Khobar (SA); Hisham Abdrabalhussain Aldaroura, Ras Tanura (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 155 days.

(21) Appl. No.: 18/423,122

(22) Filed: Jan. 25, 2024

(65) Prior Publication Data

US 2025/0243728 A1 Jul. 31, 2025

(51) Int. Cl.

| | |
|---|---|
| ***E21B 33/12*** | (2006.01) |
| ***E21B 23/14*** | (2006.01) |
| ***E21B 36/04*** | (2006.01) |

(52) U.S. Cl.

CPC ..... *E21B 33/1208* (2013.01); *E21B 23/14* (2013.01); *E21B 36/04* (2013.01); *E21B 2200/08* (2020.05)

(58) Field of Classification Search

CPC ..... E21B 33/1208; E21B 33/12; E21B 23/03; E21B 23/04; E21B 23/0413; E21B 23/042; E21B 23/0421; E21B 23/14

See application file for complete search history.

(56) References Cited

U.S. PATENT DOCUMENTS

| | | | |
|---|---|---|---|
| 5,099,919 A | 3/1992 | Schneider | |
| 7,044,230 B2 | 5/2006 | Starr et al. | |
| 7,591,318 B2 | 9/2009 | Tilghman | |
| 11,118,404 B2 | 9/2021 | Leismer et al. | |
| 2022/0243558 A1* | 8/2022 | Al Khalifah | E21B 34/06 |

FOREIGN PATENT DOCUMENTS

| | | |
|---|---|---|
| CN | 106244125 A | 12/2016 |

OTHER PUBLICATIONS

R. Vijay et al; "Successful Retrieval of Stuck Profile Plug Using Electric-Line Deployed Robotic Well Intervention Techniques"; SPE-194267-MS; Mar. 18, 2019.

* cited by examiner

*Primary Examiner* — Kristyn A Hall
(74) *Attorney, Agent, or Firm* — Vorys, Sater, Seymour and Pease LLP

(57) ABSTRACT

A wellbore system includes a production tubing extending from a surface location into a wellbore and a Y-tool assembly fluidly coupled to the production tubing. The Y-tool assembly includes a production branch having an electrical submersible pump (ESP) coupled therein and a bypass branch extending along the production branch. A wireline extends from the surface location through the production tubing and the production branch of the Y-tool assembly, and an intervention tool is coupled to a lower end of the wireline. A Y-plug is seated within the bypass branch and forms a circumferential seal with an inner wall of the bypass branch. The Y-plug includes a sealed opening through which the wireline passes and forms a dynamic seal. A release mechanism is operable to reduce a force required to unseat the Y-plug from the bypass branch to below a safety threshold tensile force defined by the wireline.

9 Claims, 6 Drawing Sheets

MECHANISMS AND SYSTEMS TO RETRIEVE WIRELINE Y-PLUG IN ESP WELLS

FIELD OF THE DISCLOSURE

The present disclosure relates generally to wireline logging operations in subterranean wellbores, and more particularly, to removing a Y-plug from the wellbore once the logging operation is complete.

BACKGROUND OF THE DISCLOSURE

Wellbores may be drilled to recover natural deposits of oil and gas, as well as other desirable materials that are trapped in subterranean geological formations. It is common practice in hydrocarbon wellbores to use Electric Submersible Pump (ESP) systems as a primary form of artificial lift, e.g., to assist in circulating the hydrocarbons to a surface location. Access to the reservoir downhole of the ESP is often required for operations such as adding additional perforations, for acidizing, scale removal or other reservoir treatments or to run specialized logging tools on coiled tubing or wireline.

To provide access to the reservoir below the ESP, a bypass system may include a Y-tool having a production branch with the ESP installed therein and a bypass branch through which logging tools and other implements may be passed. The bypass branch may normally be sealed with a blanking plug during production to prevent recirculation of wellbore fluids from the ESP discharge back into the wellbore. When an intervention or logging operation is required, the blanking plug may be replaced with a Y-plug, which permits passage of a wireline, coiled tubing or other conveyance while continuing to prevent recirculation of wellbore fluids from the ESP discharge. Where coiled tubing is used to convey a tool below a Y-plug, the Y-plug may be readily released from the wellbore by applying a sufficient tension through the coiled tubing. A wireline, however, may have insufficient tensile strength to remove the Y-plug in the same manner. In these instances, the wireline may need to be cut and retrieved from the wellbore with a costly fishing or workover operation.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a wellbore system includes a production tubing extending from a surface location into a wellbore and a Y-tool assembly fluidly coupled to the production tubing. The Y-tool assembly includes a production branch having an electrical submersible pump (ESP) coupled therein and a bypass branch extending along the production branch. A wireline extends from the surface location through the production tubing and the production branch of the Y-tool assembly, and an intervention tool is coupled to a lower end of the wireline. A Y-plug is seated within the bypass branch and forms a circumferential seal with an inner wall of the bypass branch. The Y-plug includes a sealed opening through which the wireline passes and forms a dynamic seal. A release mechanism is provided that is operable to reduce a force required to unseat the Y-plug from the bypass branch to below a safety threshold tensile force defined by the wireline.

According to another embodiment consistent with the present disclosure, a method of releasing a Y-plug from a bypass branch of a Y-tool assembly includes (a) reducing a force required to unseat the Y-plug from the bypass branch to below a safety threshold tensile force defined by a wireline, (b) engaging an intervention tool coupled to a lower end of the wireline with an underside of the Y-plug, and (c) tensioning the wireline to thereby convey the Y-plug and the intervention tool out of the Y-tool assembly.

According to another example embodiment of the present disclosure, a Y-plug apparatus includes a circumferential housing supporting a seal member thereon for forming a circumferential seal with an inner wall of Y-tool assembly. An opening extends axially through the circumferential housing for forming a dynamic seal with a wireline passing through the opening, and a release mechanism includes a plurality of legs within the circumferential housing and extendable from the circumferential housing to thereby reduce a force required to unseat the Y-plug from the Y-tool assembly.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
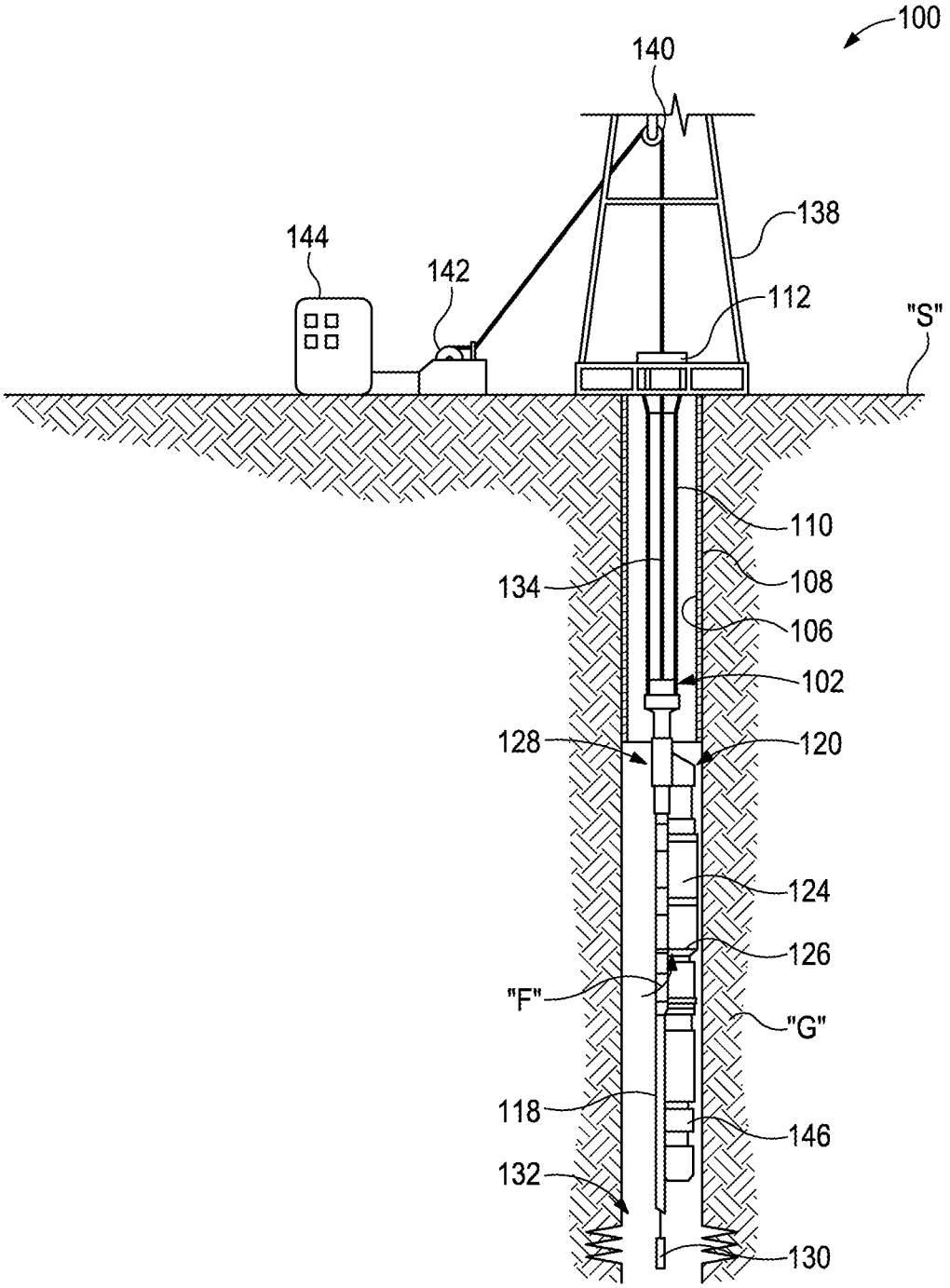
FIG. 1 is a schematic view of an example wellbore system including an ESP Y-tool assembly having a production branch and a bypass branch in accordance with one or more aspects of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to systems and methods for releasing a Y-plug from a bypass branch of a wellbore Y-tool. The systems include a release mechanism operable to reduce a force required to unseat the Y-plug from the bypass branch of below a safety threshold tensile force defined by the wireline. The release mechanisms may include a mechanical jarring unit carried by a logging tool below the Y-plug for impacting an underside of the Y-plug. Some mechanical jarring units include a single spring-loaded hammer and other mechanical jarring systems may include a pair of alternatingly reciprocating hammers for impacting the Y-plug on opposite sides to release the Y-plug. Some methods include degrading a portion of the Y-plug, for example with a resistive heater, with heat present in the downhole environment and/or an acid pumped from a surface location. In some embodiments, a Y-plug may include a plurality of legs that are selectively extendable to release the Y-plug from the Y-tool.

FIG. 1 is a schematic view of an example wellbore system 100 including a Y-tool assembly 102 in accordance with one or more exemplary embodiments of the disclosure. The wellbore system 100 is partially disposed in a wellbore 106 extending from a surface location "S" and traversing a geologic formation "G." In the illustrated example, the wellbore 106 is substantially vertical. In other embodiments, aspects of the disclosure may be practiced in a wide variety of vertical, directional, deviated, slanted and/or horizontal wellbore portions, and may extend along any trajectory through the geologic formation "G." As illustrated in FIG. 1, the wellbore 106 is partially lined with a string of wellbore liner or casing 108, however, in other embodiments, the wellbore 106 may be uncased without departing from the scope of the disclosure.

In the illustrated embodiment, the wellbore system 100 includes a string of production tubing 110 extending into the wellbore 106 from a wellhead 112 at the surface location "S." The production tubing 110 may be constructed of a series of pipe sections coupled to one another in an end-to-end manner, or in some embodiments, the production tubing 110 may be a continuous string of flexible tubing. The wellhead 112 generally provides a suspension point for the casing 108 and the production tubing 110 and also provides pressure control for the wellbore 106. The wellhead 112 may include a system of valves and adaptors that distribute (convey) wellbore fluids produced through the production tubing 110 to appropriate destinations. For example, wellbore fluids may be directed from the production string 110 through a tee to a collection tank, pipeline or another destination.

The Y-tool assembly 102 is coupled to a lower end of the production tubing 110 and is fluidly coupled thereto. Wellbore fluids from an annulus 118 around the Y-tool assembly 102 may enter the production tubing 110 through a production branch 120 of the Y-tool assembly 102. The production branch 120 generally includes an electric submersible pump or "ESP" 124 disposed therein, which may pump wellbore fluids "F" through an intake 126 into the production tubing 110. A bypass branch 128 of the Y-tool assembly 102 provides access for a logging tool 130 to a wellbore portion 132 below (downhole of) the ESP 124 without removing the ESP 124 from the wellbore 106. The ESP 124 may continue to operate as the logging tool 130 is passed through the bypass branch 128 and while performing a logging operation in the wellbore portion 132. In other embodiments, the logging tool 130 may be replaced with a different type of bottom hole assembly (BHA) or intervention tool operable to conduct any number of workover or intervention operations such as perforating, acidizing or other wellbore treatments without departing from the scope of the disclosure.

The logging tool 130 may be conveyed through the production tubing 110 and the bypass branch 128 of the Y-tool assembly 102 on a wireline 134. To support the wireline 134, the wellbore system 100 includes a derrick 138 supporting a pulley 140 over the wellbore 106. In some wireline operations, an arrangement of cables, cranes and other equipment (not shown) may substitute for the derrick 138. The pulley 140 guides the wireline 106 out of the wellbore 102 to a winch 142. The winch 142 may be operated to wind and unwind the wireline 134 to respectively raise (convey uphole) and lower (convey downhole) the logging tool 130 in the wellbore 106. The wireline 134 may be constructed as thin, flexible cable having power and data transmission lines extending therethrough. In other embodiments, the wireline 134 may be replaced with other types of conveyance, such as slickline, coiled tubing, a drill string, etc., without departing from the scope of the disclosure.

To operate the ESP 124, the logging tool 130 and/or other components of the wellbore system 100, a controller 144 is provided at the surface location "S." The controller 144 is operably coupled to the wireline 134, the logging tool 130 and the other components of the wellbore system 100 to provide power, instructions (command signals) and data thereto. In some embodiments, the controller 144 may also be communicatively coupled to one or more downhole sensors or other devices to receive data therefrom. For example, the wellbore system 100 may include a sensor 146 forming part of the Y-tool assembly 102 and arranged adjacent the intake 126 to provide data regarding the composition or conditions of the wellbore fluids entering the Y-tool assembly 102. In some embodiments, the controller 144 may be a computer-based system that may include a processor, a memory storage device, and programs and instructions, accessible to the processor for executing the instructions utilizing the data stored in the memory storage device. In other embodiments, the controller 144 may include manual controls that may be manipulated by an operator to control any of the procedures and equipment described herein.

Figure 2C:
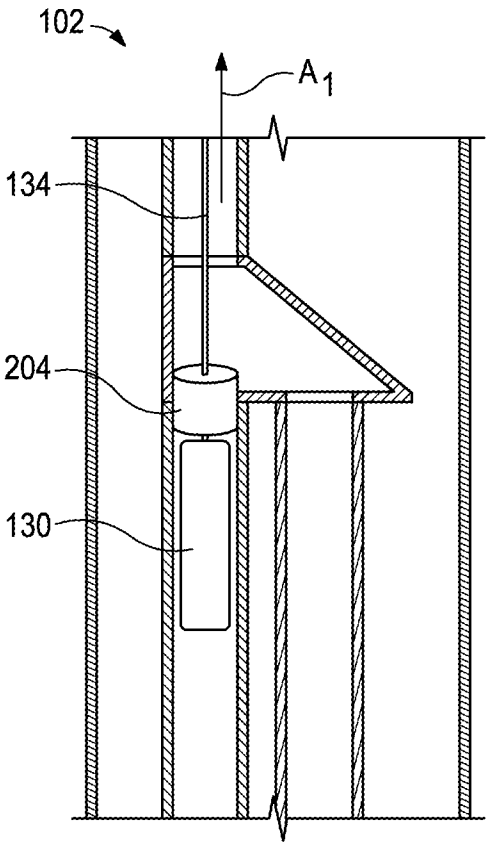
FIG. 2C is an enlarged schematic view of the Y-tool assembly in a second operational configuration wherein the logging tool is being engaged with the Y-plug in an attempt to remove the Y-plug following the logging operation.
Figure 2B:
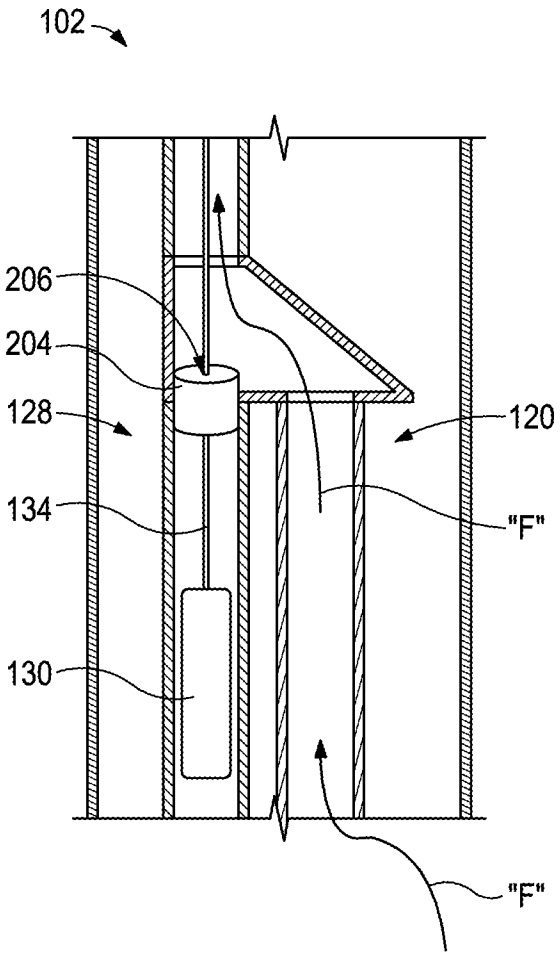
FIG. 2B is an enlarged schematic view of the Y-tool assembly in a first operational configuration where a logging tool is being conveyed below a Y-plug to conduct a logging operation.
Figure 2A:
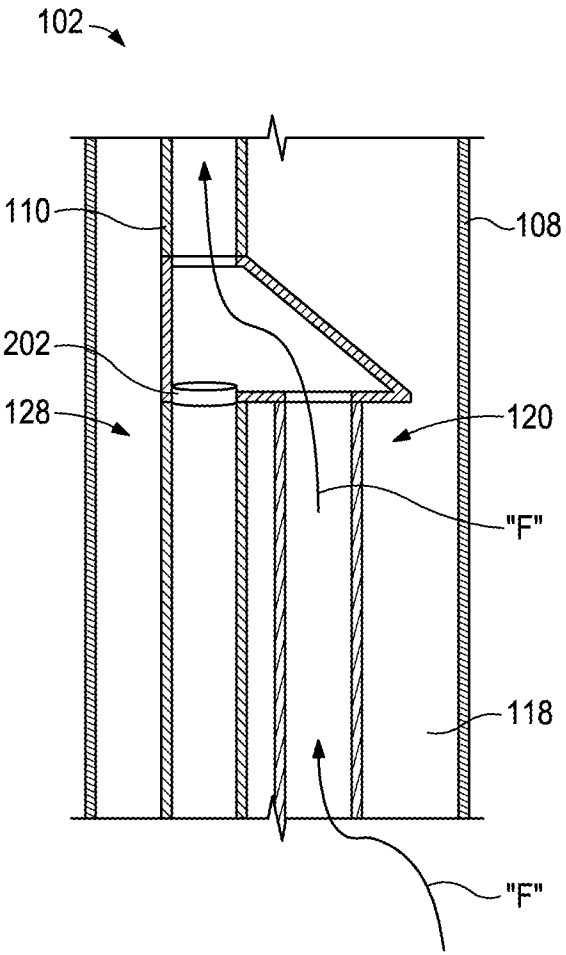
FIG. 2A is an enlarged schematic view of the Y-tool assembly in a production configuration with a blanking plug installed in the bypass branch.

FIG. 2A is a schematic view of the Y-tool assembly 102 in a production configuration wherein a blanking plug 202 is installed in the bypass branch 128. Wellbore fluids "F" enter the production branch 120 from the annulus 118 defined between the Y-tool assembly 102 and the casing 108 (or other wellbore wall). The blanking plug 202 establishes a seal across the bypass branch 128, which prevents any backflow of wellbore fluids "F" through the bypass branch 128 and ensures the wellbore fluids "F" enter the production tubing 110. When a logging operation or other intervention is required, the blanking plug 202 may be removed from Y-tool assembly 102, e.g., by wireline, to provide access through the bypass branch 128.

FIG. 2B is a schematic view of the Y-tool assembly 102 in a first operational configuration where the blanking plug 202 (FIG. 2A) has been removed and a Y-plug 204 has been installed in the bypass branch 128. The Y-plug 204 may be lowered into the bypass branch 128 on the wireline 134 with the logging tool 130 coupled beneath the Y-plug 204. Once the Y-plug 204 seats in the bypass branch 128, a seal is established across the bypass branch 128, similar to the seal facilitated with the blanking plug 202 described above. Additionally, the Y-plug 204 forms a dynamic seal with the wireline 134 such that the wireline 134 may pass through a sealed opening 206 defined in the Y-plug 204. In other words, the wireline 134 may be raised and lowered through the sealed opening 206 to thereby raise (convey uphole) and lower (convey downhole) the logging tool 130 to conduct a logging operation. Accordingly, wellbore fluids "F" may continue to be produced through the production branch 120 while the logging operation is conducted.

FIG. 2C is a schematic view of the Y-tool assembly 102 in a second operational configuration wherein the logging tool 130 is being engaged with the Y-plug 204 once a logging operation is complete. The wireline 134 may be pulled in an upward or uphole direction, e.g., in the direction of arrow $A_1$ by winding the wireline 134 on the winch 142 (FIG. 1), in an attempt to unseat and remove the Y-plug 204 following the logging operation. However, since a tension limit of the wireline 134 may be relatively low compared to coiled tubing or to other types of conveyances, the wireline 134 could be damaged or need to be cut, which may result in costly fishing an workover operations to retrieve the wireline and the logging tool 130. According to embodiments of the present disclosure, the wellbore system 100 may further include a jarring unit coupled to or forming part of the logging tool 130 and configured to jar the Y-plug 204 loose from the bypass branch 128.

Figure 3:
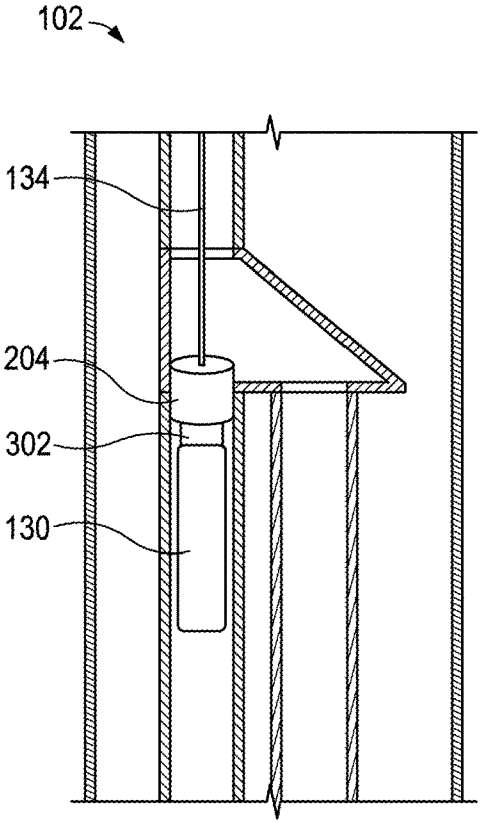
FIG. 3 is an enlarged schematic view of a logging tool with a mechanical jarring unit coupled to an upper end thereof for engaging the Y-plug to facilitate release of the Y-plug from the Y-tool assembly.

FIG. 3 is schematic view of the logging tool 130 with a release mechanism including a mechanical jarring unit 302 carried by, coupled to, or forming an upper end of the logging tool 130 in accordance with aspects of the present disclosure. The logging tool 130 may be raised (conveyed uphole) until the mechanical jarring unit 302 engages the Y-plug 204. The mechanical jarring unit 302 may be operable to impact (e.g., provide a jarring force to) an underside of the Y-plug 204 in a variety of ways to facilitate release of the Y-plug 204 from the Y-tool assembly 102. Instructions (command signals) and power may be provided to the mechanical jarring unit 302 through the logging tool 130 and/or the wireline 134.

Figure 4B:
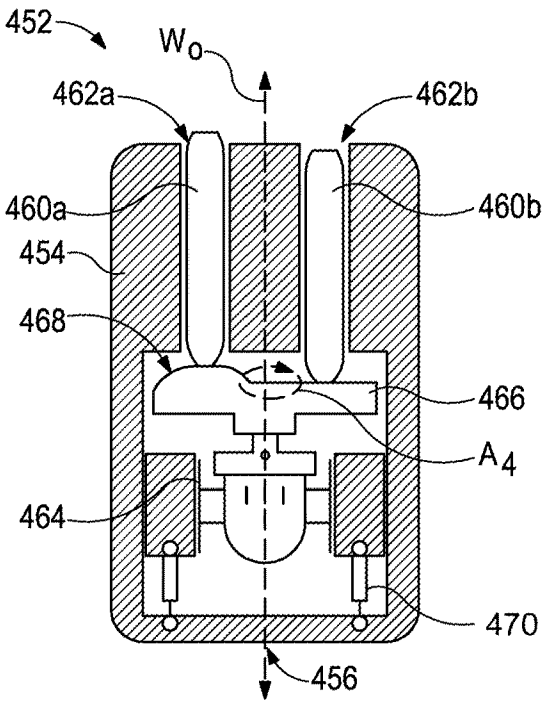
FIGS. 4A and 4B are schematic views of different embodiments of the mechanical jarring system of FIG. 3 including, respectively, a single, spring loaded hammer and pair of alternating hammers positioned on opposite lateral sides of the jarring system.
Figure 4A:
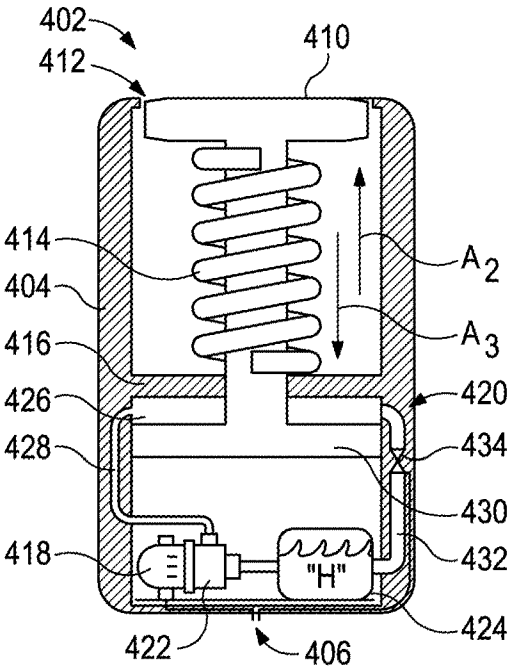

FIG. 4A is a schematic view of one example of a mechanical jarring unit 402 that may be employed in the manner of the mechanical jarring unit 302 of FIG. 3. The mechanical jarring unit 402 may be the same as or similar to the mechanical jarring unit 302 of FIG. 3. With reference to FIG. 4A and continued reference to FIG. 3, the mechanical jarring unit 402 includes an outer housing 404 having a connector 406 for coupling the mechanical jarring unit 402 to the logging tool 130. The connector 406 may include latches, threads or other fasteners for physically joining the outer housing 404 to the logging tool 130, as well as electrical conduits for the transmission of power and instructions between the mechanical jarring unit 402 and the logging tool 130.

The mechanical jarring unit 402 includes a reciprocating hammer 410 that is extendable through an opening 412 defined at the upper (uphole) end of the outer housing 404 to impact the Y-plug 204 (FIG. 3). The reciprocating hammer 410 may be biased in the direction of arrow $A_2$ by a biasing member 414 coupled between the hammer 410 and a shoulder 416 extending from the outer housing 404. The biasing member 414 may include a coiled spring, as illustrated, or in other embodiments may include Bellville washers, foam springs or other biasing mechanisms or devices recognized in the art. The mechanical jarring unit 402 may be prepared for jarring by selectively moving the hammer 410 in the direction of arrow $A_3$ and against the bias of the biasing member 414 with a motor 418 coupled to a hydraulic mechanism 420. The motor 418 may be electrically coupled to the logging tool 130 through the connector 406.

The hydraulic mechanism 420 includes a pump 422 operably coupled to the motor 418 to circulate a hydraulic fluid "H" within the outer housing 404. The pump 422 is fluidly coupled between a source 424 of the hydraulic fluid "H" and a hydraulic chamber 426 by a supply line 428. The hydraulic chamber 426 is defined between a piston 430 of the hammer 410 and the shoulder 416 such that pressurizing the hydraulic chamber 426 may move the hammer 410 in the direction of arrow $A_3$. The hydraulic chamber 426 is further fluidly coupled to the source 424 through a return line 432. The return line 432 may include a valve 434 that may be closed to permit hydraulic fluid "H" pumped into the hydraulic chamber 426 to accumulate to thereby pressurize the hydraulic chamber 426. The valve 434 may be opened to permit hydraulic fluid "H" to flow back to the source 424. The valve 434 may be electrically coupled to the logging tool 130 through the connector 406 such that the valve 434 may receive instructions (command signals) to open and close through the logging tool 130.

In operation, with the valve 434 in a closed position, the motor 418 may be operated to drive the pump 422 and thereby deliver hydraulic fluid "H" from the source 424 to the hydraulic chamber 426 through the supply line 428. The hydraulic chamber 426 is pressurized to drive the piston 430 and the rest of the hammer 410 downward in the direction of arrow $A_3$. The biasing member 414 is thereby compressed. Next, command signals may be issued to the motor 418 to cease operation and to move the valve 434 to an open position. The hydraulic fluid "H" is then free to flow to the source 424 through the return line 432, which evacuates the hydraulic chamber and allows the biasing member 414 to drive the hammer 410 in the direction of arrow $A_2$. The hammer 410 may thereby impact the underside of the Y-plug 204 to loosen the Y-plug 204 from the Y-tool assembly 102. The hammer 410 may be reciprocated in this manner multiple times and until the Y-plug 204 is sufficiently loose to be removed by the wireline 134.

FIG. 4B is a schematic view of another example of a mechanical jarring unit 452 that may be employed in the manner of the mechanical jarring unit 302 of FIG. 3. Accordingly, the mechanical jarring unit 452 may be the same as or similar to the mechanical jarring unit 30. With reference to FIG. 4B and continued reference to FIG. 3, the mechanical jarring unit 452 includes an outer housing 454 having a connector 456 for coupling the mechanical jarring unit 352 to the logging tool 130. Similar to the connector 406 (FIG. 4A) described above, connector 456 may include latches, threads or other fasteners for physically joining the outer housing 454 to the logging tool 130, as well as electrical conduits for the transmission of power and instructions between the mechanical jarring unit 452 and the logging tool 130.

The mechanical jarring unit 452 includes a pair of reciprocating hammers 460*a*, 460*b* that are extendable through respective openings 462*a*, 462*b* in the outer housing 454 to impact the Y-plug 402. The reciprocating hammers 460*a*, 460*b* are disposed on opposite lateral sides of a central axis $X_0$ extending through the mechanical jarring unit 452. Thus, the reciprocating hammers 460*a*, 460*b* impact the Y-plug 204 on opposite lateral sides thereof, to progressively loosen the Y-plug 204 from the Y-tool assembly 102. The hammers 460*a*, 460*b* are operably coupled to a motor 464 by a drive plate 466. The motor 464 is operable to rotate the drive plate 466 about the central axis $W_0$ in the direction of arrow $A_4$. The drive plate 466 is profiled with an axial or bulbous protrusion 468 on one lateral side thereof such that the axial protrusion 468 may engage an individual one of the hammers 460*a*, 460*b* to extend the individual hammer from the outer housing 454. Thus, as illustrated in FIG. 4B, the axial protrusion 468 is engaged with the first hammer 460*a*, which is extended while the second hammer is 460*b* is withdrawn within the outer housing 454. Similarly, the drive plate 466 may be rotated to engage the second hammer 460*b* to extend the second hammer 460*b* as the first hammer 460*a* is withdrawn. In operation, the motor 464 may be rotated to alternatingly extend the first and second hammers 460*a*, 460*b* to impact the Y-plug 204 on alternating lateral sides thereof. Each impact may tilt the Y-plug in an opposite direction from the previous impact to loosen and unseat the Y-plug 204 from the Y-tool assembly 102.

In some embodiments, the mechanical jarring unit 452 may include shock absorbers 470 therein for dampening any vibrations transferred to the logging tool 130. In other embodiments, however, the shock absorbers 470 may not be necessary since the hammers 460*a*, 460*b* may unseat the Y-plug 204 by applying repeated impacts of a relatively low force.

Figure 5B:
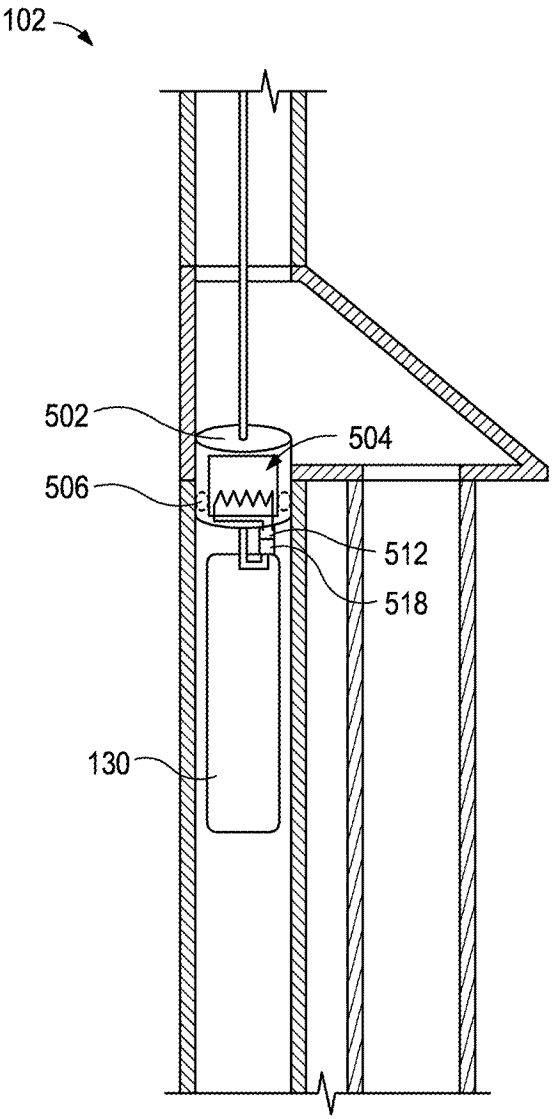
FIGS. 5A and 5B are schematic views of the Y-tool assembly in which a Y-plug including an electric resistive heater is installed, respectively illustrating the heater in an inactive configuration and an operational configuration where the resistive heater is energized by engagement of the logging tool with the Y-plug.
Figure 5A:
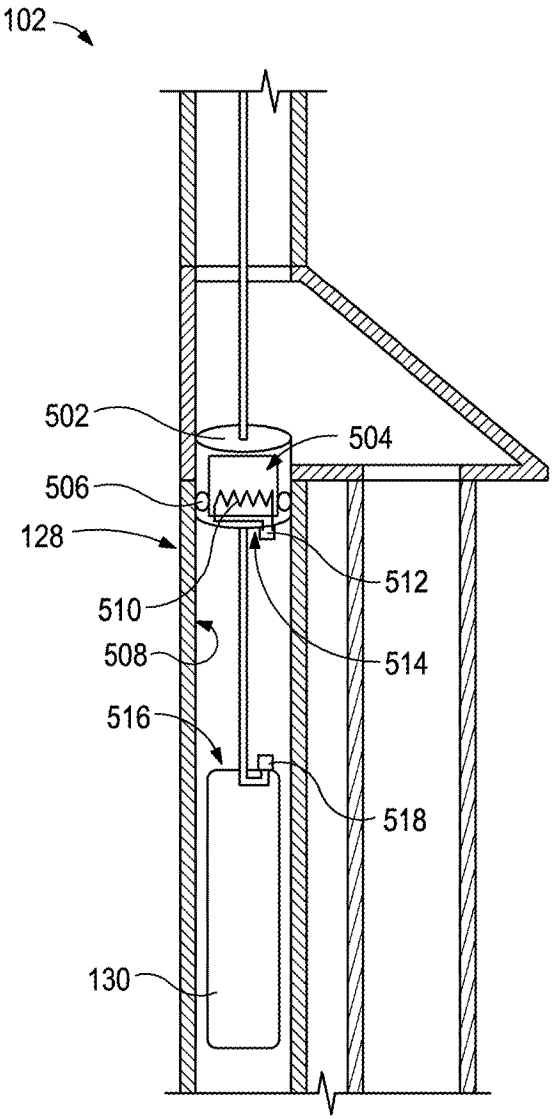

FIGS. 5A and 5B are enlarged schematic views of the Y-tool assembly 102 in which a Y-plug 502 includes a release mechanism having an electric resistive heater 504. FIG. 5A illustrates the Y-plug 502 in an inactive configuration wherein the resistive heater 504 is not energized. A sealing member 506 extends circumferentially around an outer surface of the Y-plug 502 and establishes a seal with an inner wall 508 of the bypass branch 128. Thus, the Y-plug 502 may prevent recirculation of wellbore fluids "F" through the bypass branch 128 while the logging tool 130 is maneuvered below the Y-plug 502 to conduct a logging operation. In some embodiments, the resistive heater 504 may include a nickel-chromium coil 510 or other heating element disposed on an interior of the Y-plug 502 and circumferentially within the sealing member 506. The coil 510 is operable to deliver heat to the sealing member 506, and in some embodiments, may heat the sealing member 506 to temperatures of 500° C. or more. The sealing member 506 may be constructed of a material configured to melt or dissolve at temperatures in the range of about 200° C. to about 300° C. In at least one embodiments, the sealing member 506 may be made of an elastomeric material.

The resistive heater 504 is electrically coupled to a first terminal head 512 defined or provided on an underside 514 of the Y-plug 502. The underside 514 of the Y-plug 502 opposes an upper surface 516 of the logging tool 130 where a second terminal head 518 is defined or provided. The second terminal head 518 is electrically coupled to the wireline 134 or another source of electrical power within the logging tool 130. When a logging operation is complete, the logging tool 130 may be raised (conveyed uphole) until the second terminal head 518 contacts the first terminal head 512, as illustrated in FIG. 5B. An electrical current may then be supplied through the first and second terminal heads 512, 518 to energize the resistive heater 504, which will dissolve and/or degrade the sealing member 506. With the sealing member 506 degraded, a relatively low uphole force may be applied to release the Y-plug 502 from the bypass branch 128. The wireline 134 may be wound onto the winch 142 (FIG. 1) to apply the uphole force with the logging tool, and then the logging tool 130 and the Y-plug 502 may be conveyed uphole.

Figure 6B:
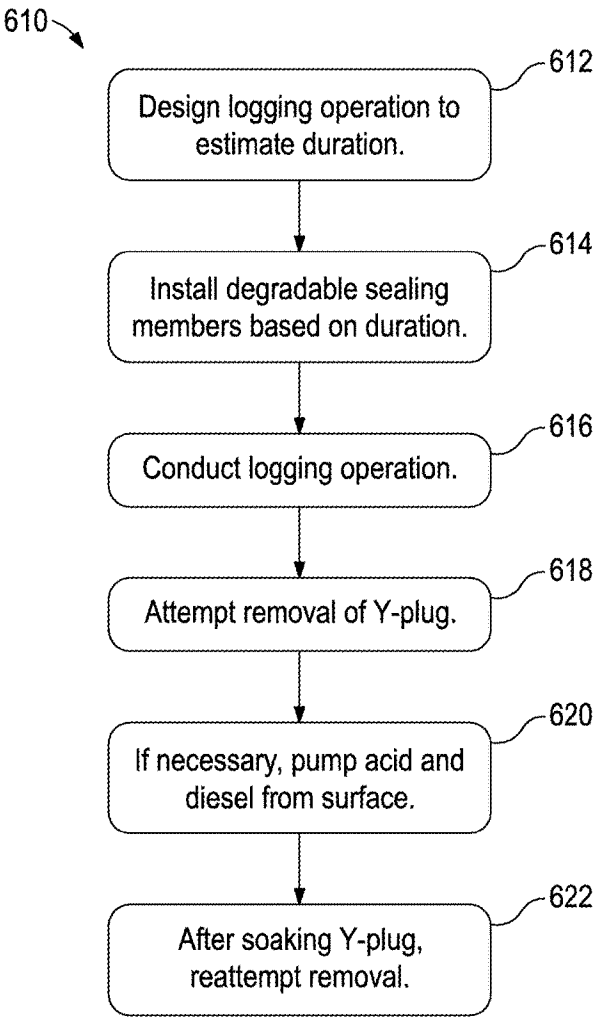
FIG. 6B is a flow chart illustrating an example procedure for removing the Y-plug of FIG. 6A from a wellbore.
Figure 6A:
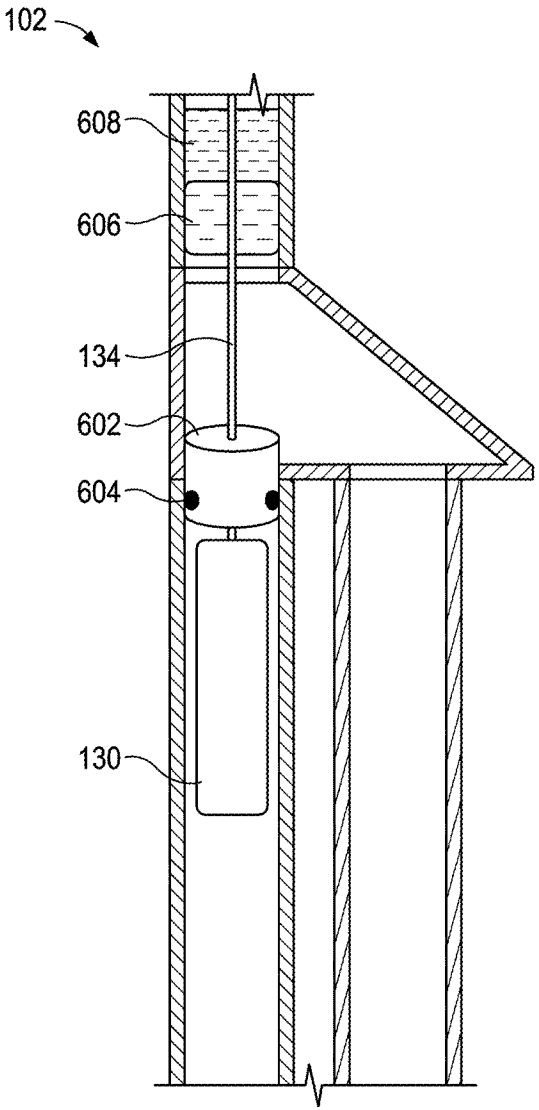
FIG. 6A is a schematic view of the Y-tool assembly in which a Y-plug including a degradable seal member is installed.

Referring now to FIG. 6A, a schematic view of the Y-tool assembly 102 is illustrated with an example Y-plug 602 having a release mechanism including a degradable seal member 604 installed therein. The degradable seal member 604 may be made of a material configured to degrade at downhole temperatures that the seal member 604 is expected to be subjected to during a logging operation and within the expected duration of the logging operation, or shortly after the logging operation is completed. In some embodiments, the degradation of the seal member 606 may be facilitated by a weak acid 606, and dislodging the Y-plug 602 with the logging tool 130 and wireline 134 may be facilitated with a lubricant 608 as described in greater detail below.

Referring now to FIG. 6B, with continued reference to FIG. 6A, an example method or procedure 610 is illustrated for removing the Y-plug 602 from the Y-tool assembly 102 following a logging operation or other downhole intervention. Initially at step 612, the logging operation is designed and planned. An expected duration of the logging operation may thereby be determined, and environmental conditions, including a downhole temperature, to which the Y-plug 602 is expected to be exposed are determined or estimated. At step 614, the degradable seal member 604 is selected based on the environmental conditions and estimated duration of the logging operation. For example, if the logging operation is expected to last 1-2 days and the Y-plug 602 is expected to be exposed to temperatures in the range of about 150° F. to about 200° F. (about 65° C. to about 93° C.), an elastomer may be selected for the degradable seal member 604 that is expected to degrade within 2 days of exposure to the downhole environment. For example, standard Nitrile Butadiene Rubber (NBR) may be employed without any special heat-resistant additivities or formulations. Other elastomers such as Hydrogenated Nitrile Butadiene Rubber (HNBR) or perfluoroelastomer (FFKM), which have relatively high heat resistance, may not be suitable for degradation without introducing external heat.

In some embodiments, the elastomer selected for the seal member 604 may also be selected based on the ability of the elastomer to degrade in a weak acid. The degradable seal member 604 may then be installed. For example, a blanking plug 202 (FIG. 2A) may be removed from the Y-tool assembly 102 and the Y-plug 602 may subsequently be sealed in the Y-tool assembly 102 with the degradable seal member 604. The Y-plug 602 may be lowered (conveyed downhole) on the wireline 134 above the logging tool 130 and seated within the Y-tool assembly 102.

Next, at step 616 the logging operation or other downhole intervention may be conducted through the Y-plug 602. The Y-plug 602 may maintain a dynamic seal around the wireline 134 while the logging tool 130 is conveyed uphole and downhole. The seal member 604 may maintain a seal around an outer circumference of the Y-plug 602 while the seal member 604 begins to degrade such that the Y-plug 602 may prevent recirculation of wellbore fluids "F" (FIG. 2B) produced through an ESP 124 (FIG. 1) during the duration of the logging operation. Once the logging operation is complete, the procedure 610 may proceed to step 618 where an attempt to remove the Y-plug 602 is made. The logging tool 130 may be conveyed uphole and until the logging tool 130 engages the Y-plug 602. A tension applied to the wireline 134 may be increased and monitored until either the Y-plug 602 is unseated or the tension reaches a predetermined safety threshold tensile wireline force. If the seal member 604 degraded sufficiently during the logging operation, the Y-plug 602 may be unseated before the safety threshold is reached and the Y-plug 602 may be conveyed out of the wellbore on the logging tool 130. If the safety threshold is reached before the Y-plug 602 is unseated, the procedure 610 may proceed to step 620.

At step 620, a slug of weak acid 606 may be pumped downhole toward the Y-plug 602. In some embodiments, the acid 606 may include, e.g., 5% acetic acid. The acid 606 may be displaced with a lubricant 608, such as diesel, until the acid 606 reaches the Y-plug 602. The acid 606 may be maintained around the Y-plug 602 for a predetermined soaking interval. After the soaking interval, the procedure 610 may proceed to step 622 where another attempt to remove the Y-plug 602 is made. The degradation of the seal member 604 induced by the acid 606, together with lubrication provided by the lubricant 608 will enhance the chance of retrieving the Y-plug 602 before the safety threshold tension is reached.

Figure 7B:
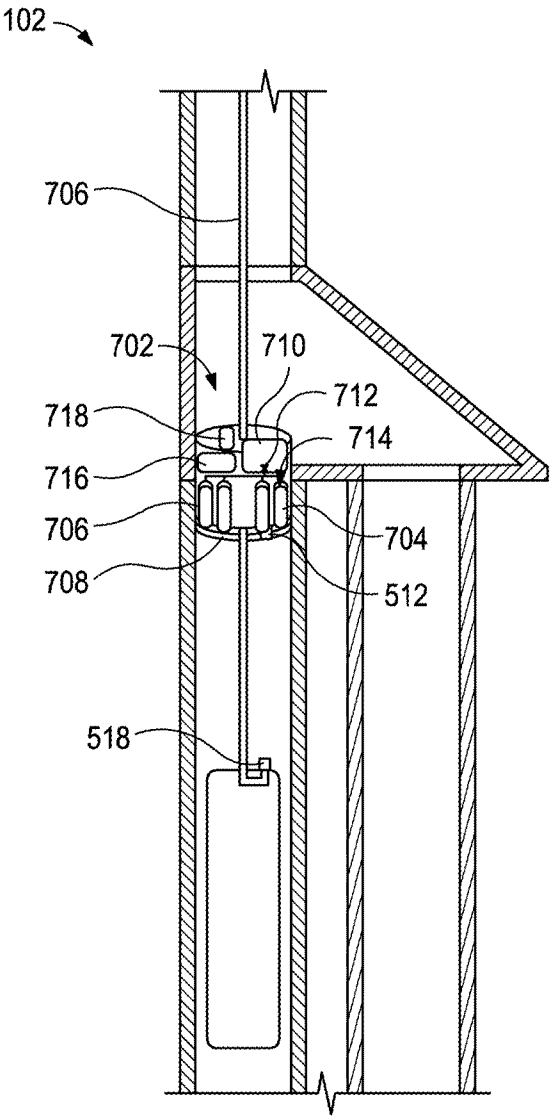
FIGS. 7A and 7B are schematic views of the Y-tool assembly with a self-releasing Y-plug installed therein in a respective first operational configuration where a plurality of legs are retracted and a respective second operational configuration where the plurality of legs are extended to release the Y-plug from the Y-tool.
Figure 7A:
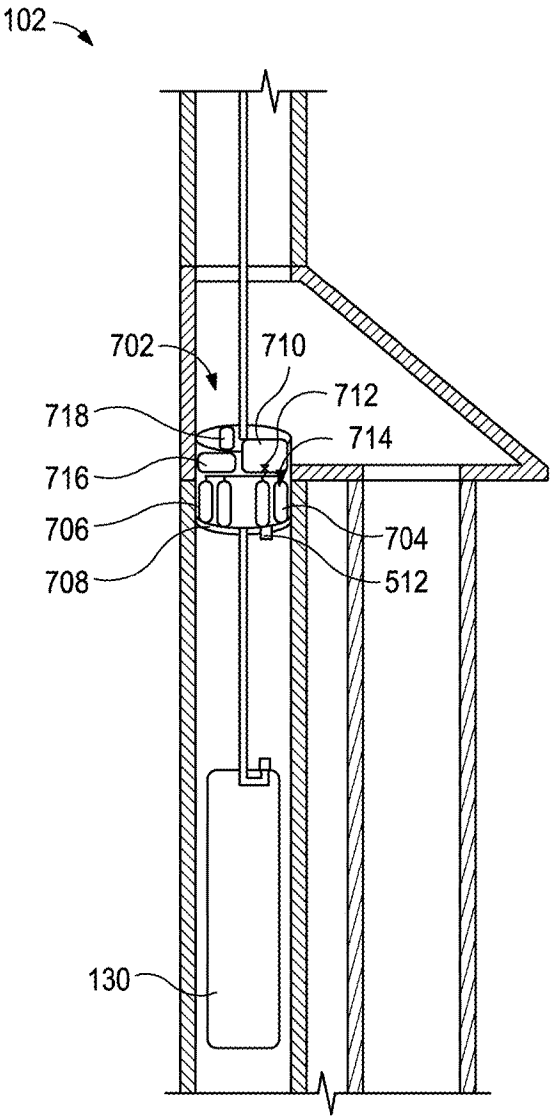

FIGS. 7A and 7B are schematic views of the Y-tool assembly 102 with a self-releasing Y-plug 702 installed therein. FIG. 7A illustrates the self-releasing Y-plug 702 in a first operational configuration where release mechanism includes a plurality of legs 704, which are retracted within a circumferential housing 706 of the Y-plug 702. The circumferential housing 706 may support a seal member thereon, e.g., seal member 506 (FIG. 5A) or seal member 604 (FIG. 6A), for forming a circumferential seal with the Y-tool assembly 102. With the legs 704 retracted, the Y-plug 702 may be seated against a ledge 708 or another profile feature defined on the inner wall 508 of the bypass branch 128. The Y-plug 702 includes a fluid source 710 therein, which may include compressed nitrogen in some embodiments. A valve 712 is fluidly coupled to the source of nitrogen 710 and operable to release a fluid from the fluid source 710. The release of the fluid pressurizes a piston surface 714 of the legs 704 and extends the plurality of legs 704 from the housing 706. The Y-plug 702 is thereby moved to a second operational configuration, as illustrated in FIG. 7B. In the second operational configuration, the legs 704 may be extended a distance of about 0.1 inches to about 0.5 inches (about 2.5 mm to about 12.7 mm) against the ledge 708. This displaces the Y-plug vertically from its original position, which may unseat or 'free' the Y-plug 702 from whatever configuration or obstruction made it stuck in the first place, and facilitates the removal tools, e.g., the Y-plug 702 and the logging tool 130 out of the well. The legs 704 press against the ledge 708 to unseat the Y-plug 702 and permit removal of the Y-plug 702 with the wireline 134.

The Y-plug 702 includes a memory 716 therein operably coupled to the valve 712. The memory 716 may be programmed with instructions to activate the valve 712 and release the fluid from the fluid source 710. In some embodiments, the memory 716 may be programmed to activate the valve 712 after a predetermined time interval, which may be selected based on an expected duration of a logging operation. The memory 716 may be powered by a battery 718 disposed within the housing 706 such that the Y-plug 702 may operate independently without any input from other components. In other embodiments, the memory 716 may be may be programmed to activate the valve in response to engagement of first and second terminal heads 512, 518 as described above. With the logging tool 130 approximated with the logging tool 702 and the terminal heads 512, 518 engaged with one another (see FIG. 5B), a command signal may be transmitted from the controller (FIG. 1), through the wireline 134 and the logging tool 130 to the memory 716. In response to receiving the command signal, the memory 716 may activate the valve 712 to thereby extend the legs 704 and unseat and release the Y-plug 702.

Embodiments disclosed herein include:

A. A wellbore system can include a production tubing extending from a surface location into a wellbore and a Y-tool assembly fluidly coupled to the production tubing. The Y-tool assembly can include a production branch having an electrical submersible pump (ESP) coupled therein and a bypass branch extending along the production branch. A wireline can extend from the surface location through the production tubing and the production branch of the Y-tool assembly, and an intervention tool can be coupled to a lower end of the wireline. A Y-plug can be seated within the bypass branch and form a circumferential seal with an inner wall of the bypass branch. The Y-plug can include a sealed opening through which the wireline passes and forms a dynamic seal. A release mechanism can be provided that is operable to reduce a force required to unseat the Y-plug from the bypass branch to below a safety threshold tensile force defined by the wireline.

B. A method of releasing a Y-plug from a bypass branch of a Y-tool assembly can include (a) reducing a force required to unseat the Y-plug from the bypass branch to below a safety threshold tensile force defined by a wireline, (b) engaging an intervention tool coupled to a lower end of the wireline with an underside of the Y-plug, and (c) tensioning the wireline to thereby convey the Y-plug and the intervention tool out of the Y-tool assembly.

C. A Y-plug apparatus can include a circumferential housing supporting a seal member thereon for forming a circumferential seal with an inner wall of Y-tool assembly. An opening can extend axially through the circumferential housing for forming a dynamic seal with a wireline passing through the opening, and a release mechanism can include a plurality of legs within the circumferential housing and extendable from the circumferential housing to thereby reduce a force required to unseat the Y-plug from the Y-tool assembly.

Each of embodiments A, B, and C may have one or more of the following additional elements in any combination: Element 1: wherein the release mechanism includes a mechanical jarring unit coupled to an upper end of the intervention tool, the mechanical jarring unit operable to reciprocate one or more hammers to impact the Y-plug.

Element 2: wherein the mechanical jarring unit comprises: a biasing member operably coupled to the at least one hammer to bias the at least one hammer toward the Y-plug; and a motor electrically coupled to the wireline and operably coupled to the at least one hammer to drive the at least one hammer in a direction against the bias of the biasing member. Element 3: wherein the at least one hammer includes a pair of hammers disposed on opposite lateral sides of the jarring unit and operable to alternatingly impact opposite lateral sides of the Y-plug. Element 4: wherein the release mechanism includes a heater disposed within an interior of the Y-plug and operable to provide heat to a sealing member extending circumferentially around an outer surface of the Y-plug and forming the circumferential seal with the inner wall of the bypass branch. Element 5: wherein the heater includes a heating element electrically coupled to a first terminal head defined on an underside of the Y-plug, and wherein the intervention tool includes a second terminal head defined on an upper surface of the intervention tool and electrically coupled to the wireline such that the heating element may be electrically coupled to the wireline by engaging the first and second terminal heads with one another. Element 6: wherein the release mechanism includes a degradable seal member extending circumferentially around an outer surface of the Y-plug and forming the circumferential seal with the inner wall of the bypass branch, the degradable seal member selected to degrade at temperatures in the range of about 65° C. to about 93° C. Element 7: wherein the degradable seal member is constructed of an elastomer degradable by exposure to a 5% acetic acid. Element 8: wherein the release mechanism includes a plurality of legs within the Y-plug, the legs selectively extendable against a ledge defined in the bypass branch. Element 9: further comprising a source of compressed fluid within the Y-plug, and wherein the legs are extendable in response to releasing the compressed fluid from the fluid source. Element 10: further comprising a memory within the Y-plug, the memory programmed to release the compressed fluid after a predetermined time interval.

Element 11: wherein reducing the force required includes impacting the underside of the Y-plug with at least one hammer of a mechanical jarring unit carried by the intervention tool. Element 12: wherein impacting the underside of the Y-plug includes alternatingly impacting the Y-plug on opposite lateral sides thereof with a pair of reciprocating hammers of the mechanical jarring unit. Element 13: wherein reducing the force required further includes degrading a seal member extending circumferentially around an outer surface of the Y-plug and forming a circumferential seal with an inner wall of the bypass branch. Element 14: wherein degrading the seal member includes at least one of the group consisting of: heating the degradable seal member with a heater disposed within the Y-plug; pumping an acid downhole to the expose the degradable seal member to the acid; and exposing the seal member to temperatures in the range of about 65° C. to about 93° C. Element 15: wherein reducing the force required includes extending a plurality of legs from within the Y-plug against a ledge defined in the bypass branch of the Y-tool assembly. Element 16: wherein extending the plurality of legs includes releasing a compressed fluid from a fluid source within the Y-plug such that the compressed fluid imparts a force to piston surfaces defined on the plurality of legs.

Element 17: further comprising: a source of compressed fluid within the circumferential housing; and a memory within the circumferential housing, the memory programmed to release the compressed fluid after a predetermined time interval to thereby extend the plurality of legs.

By way of non-limiting example, exemplary combinations applicable to A, B, and C include: Element 1 with Element 2; Element 1 with Element 3; Element 4 with Element 5; Element 6 with Element 7; Element 8 with Element 9; Element 11 with Element 12; Element 13 with Element 14; and Element 15 with Element 16.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A wellbore system, comprising:

production tubing extending from a surface location into a wellbore;

a Y-tool assembly operatively coupled to the production tubing and including a production branch having an electrical submersible pump (ESP) arranged therein and a bypass branch extending along and separated from the production branch;

a wireline extending from the surface location through the production tubing and the bypass branch of the Y-tool assembly;

an intervention tool coupled to a lower end of the wireline;

a Y-plug including a circumferential housing seated within the bypass branch and forming a circumferential seal with an inner wall of the bypass branch, the Y-plug including a sealed opening through which the wireline passes and forms a dynamic seal; and a release mechanism operable to displace the circumferential housing within the bypass branch and thereby reduce a force required to unseat the Y-plug from the bypass branch to below a safety threshold tensile force defined by the wireline.

2. The wellbore system of claim 1, wherein the release mechanism includes a plurality of legs within the Y-plug and selectively extendable against a ledge defined in the bypass branch.

3. The wellbore system of claim 2, further comprising a source of compressed fluid within the Y-plug, wherein the legs are extendable in response to releasing the compressed fluid from the fluid source.

4. The wellbore system of claim 3, further comprising a memory within the Y-plug programmed to release the compressed fluid after a predetermined time interval.

5. A method of releasing a Y-plug from a bypass branch of a Y-tool assembly, the method comprising:

displacing a circumferential housing of the Y-plug that forms a circumferential seal between the Y-plug and an inner wall of the bypass branch, thereby reducing a force required to unseat the Y-plug from the bypass branch to below a safety threshold tensile force defined by a wireline;

engaging an intervention tool coupled to a lower end of the wireline with an underside of the Y-plug; and tensioning the wireline to thereby convey the Y-plug and the intervention tool out of the Y-tool assembly.

6. The method of claim 5, wherein reducing the force required includes extending a plurality of legs from within the Y-plug against a ledge defined in the bypass branch of the Y-tool assembly.

7. The method of claim 6, wherein extending the plurality of legs includes releasing a compressed fluid from a fluid source within the Y-plug such that the compressed fluid imparts a force to piston surfaces defined on the plurality of legs.

8. A Y-plug apparatus, comprising:

a circumferential housing supporting a seal member thereon for forming a circumferential seal with an inner wall of Y-tool assembly;

an opening extending axially through the circumferential housing for forming a dynamic seal with a wireline passing through the opening; and a release mechanism including a plurality of legs within the circumferential housing and extendable from the circumferential housing to thereby reduce a force required to unseat the Y-plug from the Y-tool assembly.

9. The apparatus of claim 8, further comprising:

a source of compressed fluid within the circumferential housing; and a memory within the circumferential housing, the memory programmed to release the compressed fluid after a predetermined time interval to thereby extend the plurality of legs.

* * * * *